United States Patent [19]

Say

[11] 4,307,498

[45] Dec. 29, 1981

[54] ONE PIECE ASTIGMATIC GRID FOR COLOR PICTURE TUBE ELECTRON GUN AND METHOD OF MAKING SAME

[75] Inventor: Donald L. Say, Waterloo, N.Y.

[73] Assignee: North American Philips Consumer Electronics Corp., New York, N.Y.

[21] Appl. No.: 94,405

[22] Filed: Nov. 15, 1979

[51] Int. Cl.[3] ..... H01J 9/14

[52] U.S. Cl. ..... 29/25.18; 72/326

[58] Field of Search ..... 29/25.18; 72/325, 326, 72/335, 338; 113/121 C

[56] References Cited

U.S. PATENT DOCUMENTS

| | | | |
|---|---|---|---|
| 3,314,272 | 4/1967 | Dahl | 72/325 |
| 3,852,608 | 12/1974 | Johanns et al. | 313/408 X |
| 3,873,878 | 3/1975 | Odenthal | 313/449 |
| 3,931,909 | 1/1976 | Dalli et al. | 113/121 C |
| 3,980,034 | 9/1976 | Delbenham | 113/121 C |
| 4,143,293 | 3/1979 | Hosokoshi et al. | 313/409 |

*Primary Examiner*—Howard N. Goldberg
*Assistant Examiner*—K. J. Ramsey
*Attorney, Agent, or Firm*—John C. Fox

[57] ABSTRACT

A one-piece astigmatic lens is formed in a grid by lancing a section threeof, coining the lanced section to a dimension wider than the trough formed by the lanced section and providing a beam aperture in the lanced and coined section.

4 Claims, 11 Drawing Figures

ONE PIECE ASTIGMATIC GRID FOR COLOR PICTURE TUBE ELECTRON GUN AND METHOD OF MAKING SAME

TECHNICAL FIELD

This invention relates to electron guns for cathode ray tubes and more particularly to grids for producing astigmatic lenses and to a method of making such grids.

BACKGROUND OF THE INVENTION

The use of astigmatic lenses in electron guns is known. Generally, the lenses form a non-circular electron beam bundle, usually elliptical in crosssection. Exemplary lenses of this general description are shown in U.S. Pat. Nos. 3,852,608; 3,866,081; 3,873,878; 4,143,293; and in FIGS. 1 and 2 of the instant specification. These prior art lenses are complicated and expensive to make and require either a two part grid or cooperation between two or more grids.

DISCLOSURE OF THE INVENTION

It is therefore an object of this invention to provide a one-piece astigmatic lens that is economical to fabricate; one that obviates the disadvantages of the prior art.

It is another object of the invention to provide a method of making such a grid.

These objects are accomplished in one aspect of the invention by a grid whose lens area is formed by lancing the functional grid area to provide a lanced section. The upper surface of the lanced section lies below the lower or under surface of the functional grid area thus forming a trough having a given width and a depth equal to the thickness of the functional grid. Subsequently, the lanced section is coined to reduce its thickness and increase its width to greater than the width of the trough. A suitable beam aperture is then provided in the lanced section.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

As used herein the term "lanced section" refers to a section of material detached on two sides, whether opposed or contiguous, from a main body of material, usually by a shearing force, and depressed to at least some degree below the surface of the main body.

The term "coining" refers to the deformation of a material by applied pressure, whether or not the deformed material is contained in a die cavity.

Figure 1:
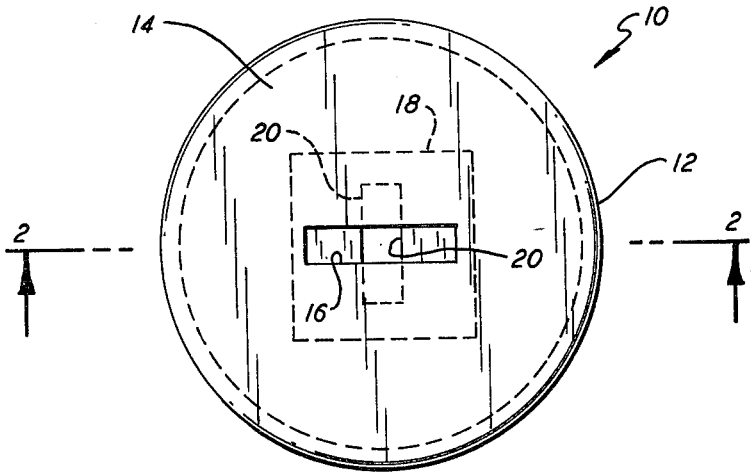
FIG. 1 Prior Art
FIG. 1 is a plan view of one form of prior art grid which will provide an astigmatic lens.
Figure 2:
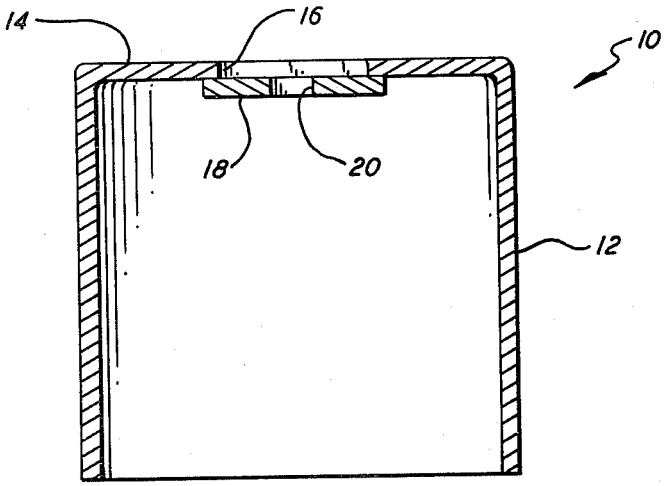
FIG. 2 Prior Art
FIG. 2 is a sectional view taken along the line 2—2 of FIG. 1.

Referring now to the drawings with greater particularity, there is shown in FIG. 1 a plan view of a prior art astigmatic lens formed in the $G_1$ or control grid 10 of an electron gun. Grid 10 in this instance is a cup-shaped structure having a peripheral wall 12 and a functional grid area 14. This area 14 is provided with an elongated, rectangular aperture 16. A second grid element 18 is provided with a similar elongated aperture 20, which latter aperture is positioned in orthogonal relation to aperture 16. Grid element 18 is welded to the underside of functional area 14 to maintain its position. When viewed in plan this construction shows a substantially square aperture leading into a rectangular slot. The shape of the aperture and slot function as an astigmatic lens in a finished electron gun, as is known in the art.

The problems with this construction are its expense, the difficulty of keeping proper alignment between the two slots and the fact that the welded areas can cause raised portions which affect the $G_1$-$G_2$ spacing and degrade the desired focus characteristics.

To obviate these disadvantages the one-piece grid of the invention is provided.

Figure 3:
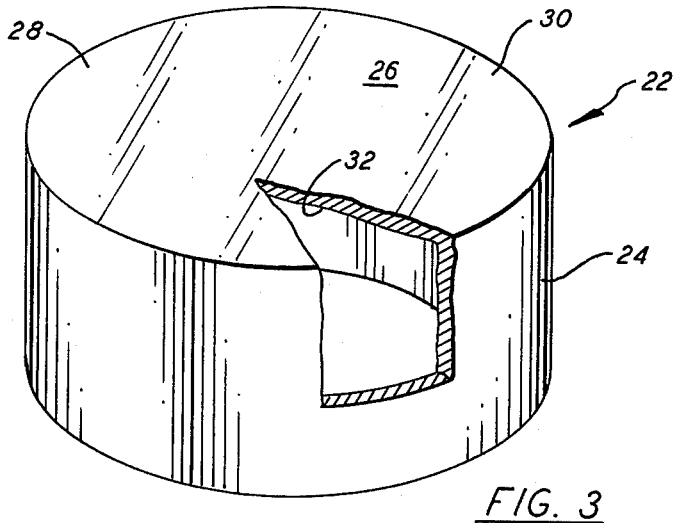
FIG. 3 is a perspective view of a functional grid blank.

Referring now to FIG. 3 there is shown a cupshaped grid blank 22 having a peripheral side wall 24 and a functional grid area 26. The functional grid area 26 is defined by a perimeter 28, in this instance circular, and an upper surface 30 and a lower surface 32 which define a given thickness therebetween.

Figure 4:
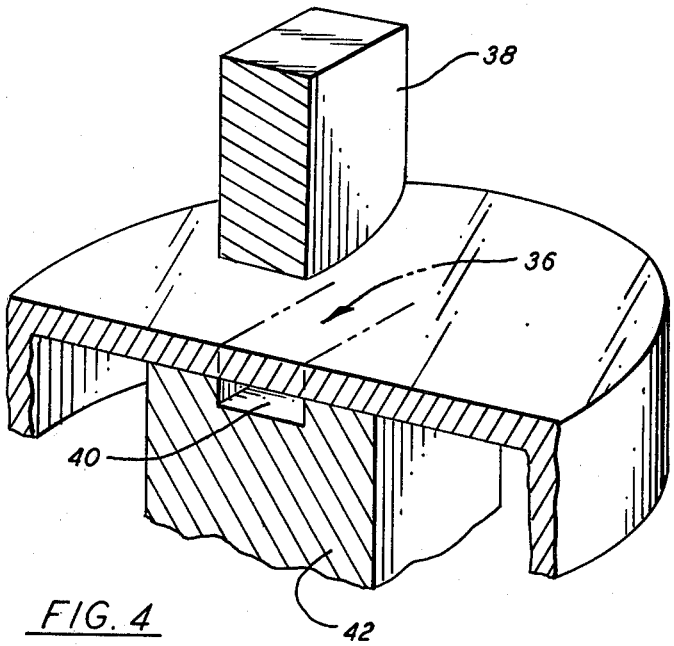
FIG. 4 is a sectional, perspective view of a first step in forming the grid.
Figure 5:
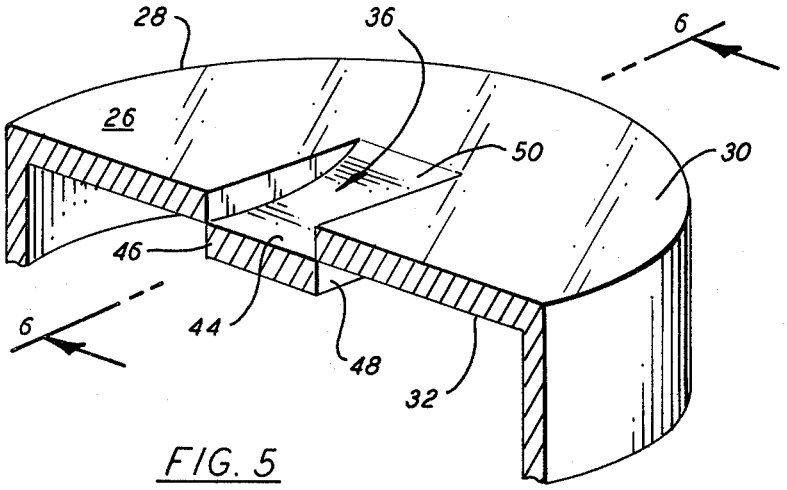
FIG. 5 is a sectional, perspective view of the grid after the first forming operation.
Figure 6:
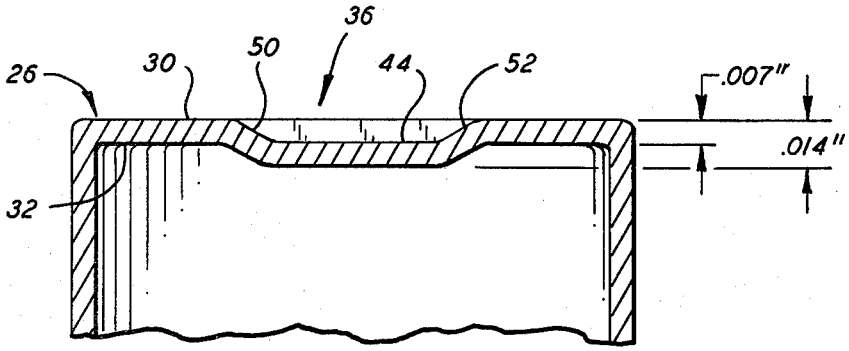
FIG. 6 is a sectional view taken along the line 6—6 of FIG. 5.

In an appropriate part of functional grid area 26 a lanced section 36 is formed as shown in FIG. 4. Herein a lancing tool 38, under pressure, drives lanced section 36 into cavity 40 in tool 42. Cavity 40 has a depth equal to or slightly greater than the thickness of functional grid area 26 so that the upper surface 44 of lanced section 36 lies below lower surface 32. Lanced section 36 thus has two sides 46 and 48 which are separated from grid area 26 and two ends 50 and 52 which remain attached thereto. FIG. 6 also illustrates this relationship as well as showing some typical dimensions.

Figure 7:
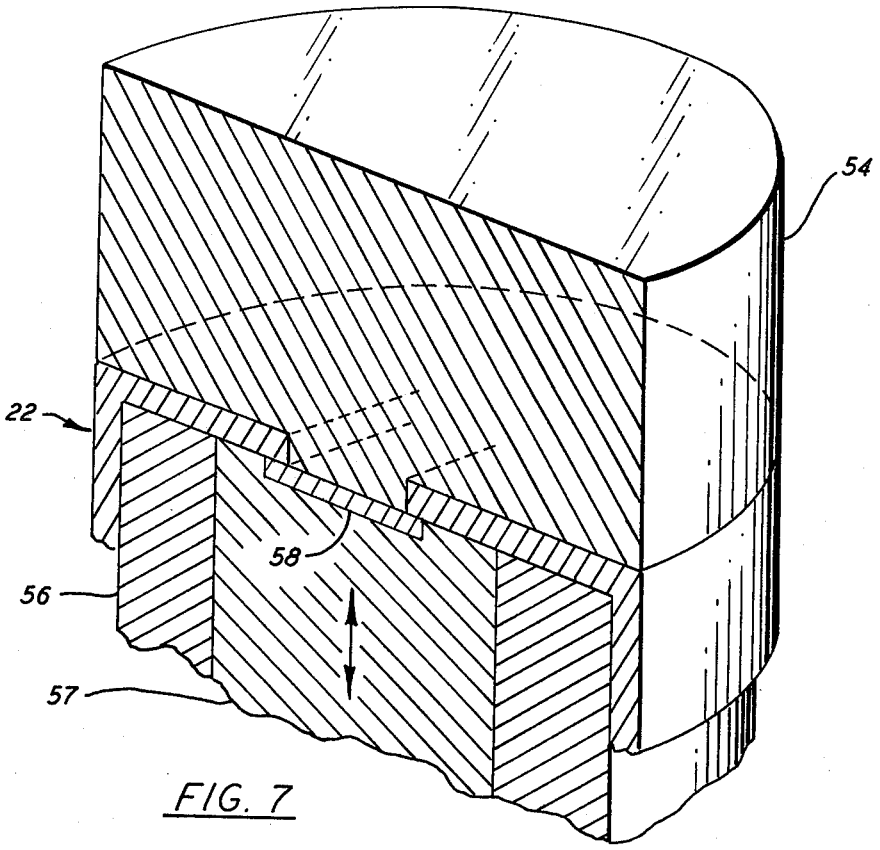
FIG. 7 is a sectional, perspective view of a second forming operation.

After lanced section 36 is formed it is coined as shown in FIG. 7. A first forming die 54 engages upper surfaces 30 and 44 to prevent unwanted deformations and a mandrel 56 engages surface 32 to support the structure. A movable coining die 57 containing a cavity 58 is mounted for operation within mandrel 56. Upon activation, die 57 engages lanced section 36 and deforms the same by decreasing its thickness and increasing its width to greater than the width of the trough formed by lanced section 36 and functional grid area 26.

Figure 8:
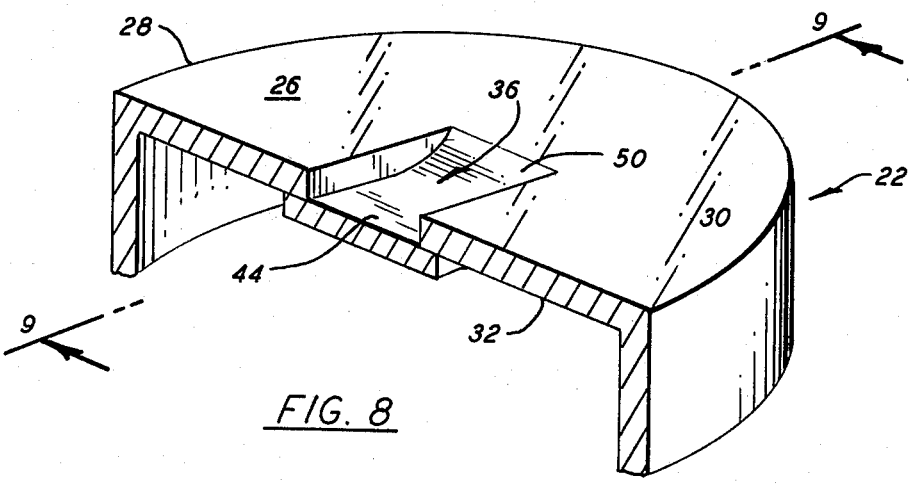
FIG. 8 is a sectional, perspective view of the grid after the second forming operation.
Figure 9:
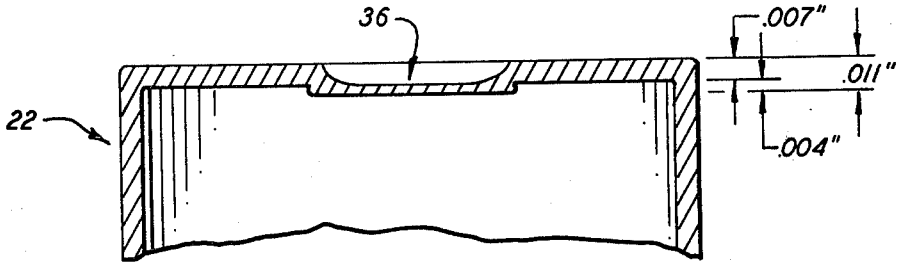
FIG. 9 is a sectional view taken along the line 9—9 of FIG. 8.
Figure 10:
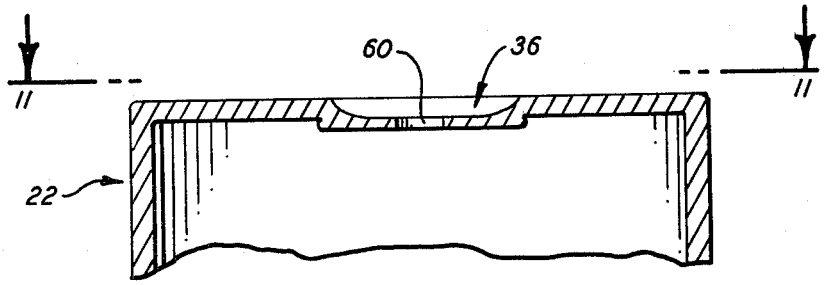
FIG. 10 is a view similar to FIG. 9 showing the results of a third forming operation.
Figure 11:
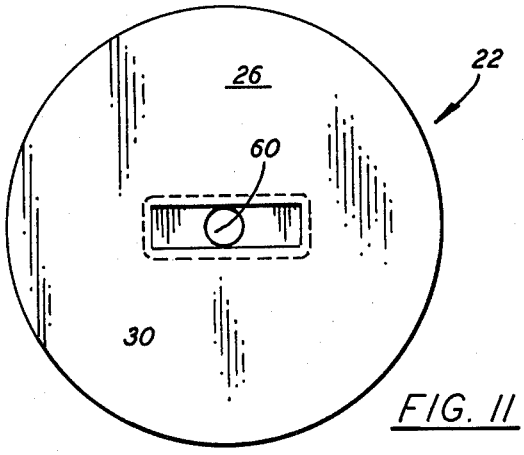
FIG. 11 is a plan view taken along the line 11—11 of FIG. 10.

The structure after the coining operation is illustrated in FIGS. 8 and 9, with FIG. 9 also showing the dimensional changes.

A beam aperture 60 is provided in lanced and coined section 36 and as shown, has a diameter equal to the width of the trough. A non-circular aperture may also be employed.

Utilization of this method and the grid formed thereby obviate many of the disadvantages of the prior art. The one-piece construction is simple and economical to build accurately since it does not possess the complexity and alignment problems of the prior art.

While there has been shown and described what is at present considered to be the preferred form of the invention, it will be apparent to those skilled in the art that various changes and modifications can be made herein without departing from the scope of the invention as defined by the appended claims.

I claim:

1. In a method of making a one piece grid which provides an astigmatic lens for a cathode ray tube electron gun, said grid having a functional grid area defined by a perimeter and upper and lower surfaces defining a given thickness therebetween, the steps comprising: lancing said functional grid area to form a lanced section whose upper surface lies below said lower surface of said functional grid area, said upper surface of said functional grid area and the upper surface of said lanced section defining a trough having a given width; and coining said lanced section to decrease its thickness and increase its width to a dimension greater than said given width.

2. The method of claim 1 wherein an aperture is provided in said lanced section.

3. The method of claim 2 wherein said aperture is circular.

4. The method of claim 3 wherein said trough is rectangular.

* * * * *